US010076678B2

(12) United States Patent
Sanseverino

(10) Patent No.: US 10,076,678 B2
(45) Date of Patent: Sep. 18, 2018

(54) EXERCISE DEVICE

(71) Applicant: Joseph Sanseverino, Clark, NJ (US)

(72) Inventor: Joseph Sanseverino, Clark, NJ (US)

( * ) Notice: Subject to any disclaimer, the term of this patent is extended or adjusted under 35 U.S.C. 154(b) by 0 days.

(21) Appl. No.: 15/659,716

(22) Filed: Jul. 26, 2017

(65) Prior Publication Data

US 2018/0028856 A1 Feb. 1, 2018

Related U.S. Application Data

(60) Provisional application No. 62/368,296, filed on Jul. 29, 2016.

(51) Int. Cl.

| | |
|---|---|
| ***A63B 21/02*** | (2006.01) |
| ***A63B 21/04*** | (2006.01) |
| ***A63B 21/055*** | (2006.01) |
| ***A63B 21/00*** | (2006.01) |

(52) U.S. Cl.

CPC ..... *A63B 21/04* (2013.01); *A63B 21/00069* (2013.01); *A63B 21/0552* (2013.01); *A63B 21/154* (2013.01); *A63B 21/4001* (2015.10); *A63B 21/4025* (2015.10); *A63B 21/00* (2013.01); *A63B 2210/00* (2013.01)

(58) Field of Classification Search

CPC ... A63B 21/00069; A63B 21/00; A63B 21/04; A63B 21/154; A63B 21/0552; A63B 21/4001; A63B 21/4025; A63B 2210/00

See application file for complete search history.

(56) References Cited

U.S. PATENT DOCUMENTS

| | | | | |
|---|---|---|---|---|
| 5,788,617 | A * | 8/1998 | Paris | A63B 21/00043 482/112 |
| 6,860,841 | B1 * | 3/2005 | Mortorano | A63B 21/0004 482/126 |
| 7,322,909 | B1 | 1/2008 | Loccarini | |
| 7,695,413 | B1 | 4/2010 | Cruz et al. | |
| 7,955,236 | B2 | 6/2011 | DiGiovanni et al. | |
| 7,963,893 | B1 | 6/2011 | Cruz et al. | |
| 8,092,353 | B2 | 1/2012 | Yang | |
| 8,348,814 | B1 | 1/2013 | Hinds | |
| 8,480,549 | B1 | 7/2013 | Hinds | |
| 8,602,952 | B1 | 12/2013 | Cruz | |
| 8,684,894 | B2 | 4/2014 | Flynn | |
| 8,777,822 | B2 | 7/2014 | Agostini | |
| 9,028,380 | B2 | 5/2015 | Hoole | |
| 2004/0132591 | A1 | 7/2004 | Gatling | |
| 2007/0155600 | A1 | 7/2007 | Cunningham et al. | |
| 2009/0192022 | A1 | 7/2009 | Kulka | |
| 2009/0253557 | A1 | 10/2009 | Klein | |
| 2010/0016132 | A1 | 1/2010 | Flynn | |

(Continued)

OTHER PUBLICATIONS

International Search Report and Written Opinion, for PCT/US2017/043829, dated Oct. 6, 2017.

*Primary Examiner* — Loan H Thanh
*Assistant Examiner* — Megan Anderson
(74) *Attorney, Agent, or Firm* — Thomas M. Finetti; Charney IP Law LLC

(57) ABSTRACT

The present disclosure provides an exercise device having two tubular members and a tension member disclosed therein and coupled thereto, the tubular members designed to be pulled away from each other, and whereby the exercise device is also capable of being attached to one or more resistance bands.

20 Claims, 7 Drawing Sheets

(56) References Cited

U.S. PATENT DOCUMENTS

| | | | |
|---|---|---|---|
| 2010/0041526 | A1 | 2/2010 | Bowser |
| 2010/0216613 | A1 | 8/2010 | Pacini |
| 2011/0251033 | A1 | 10/2011 | Blancher |
| 2011/0312477 | A1 | 12/2011 | Wiseman |
| 2012/0004082 | A1 | 1/2012 | Senegal |
| 2012/0094812 | A1 | 4/2012 | Smiley |
| 2012/0100967 | A1 | 4/2012 | Leibowitz |
| 2012/0245002 | A1 | 9/2012 | Todd |
| 2013/0178342 | A1 | 7/2013 | Ross |
| 2013/0225376 | A1 | 8/2013 | Kinsbourne |
| 2014/0073496 | A1 | 3/2014 | Bannerman |
| 2014/0106948 | A1 | 4/2014 | Agostini |
| 2014/0342883 | A1 | 11/2014 | Joost |
| 2014/0349821 | A1 | 11/2014 | Davis |
| 2015/0005141 | A1 | 1/2015 | Krahling |
| 2015/0126342 | A1 | 5/2015 | Kaye et al. |
| 2015/0126347 | A1 | 5/2015 | Kaye et al. |
| 2015/0133276 | A1 | 5/2015 | Kaye et al. |
| 2015/0182776 | A1 | 7/2015 | Lewen |
| 2015/0246256 | A1 | 9/2015 | Powell |

* cited by examiner

EXERCISE DEVICE

CROSS-REFERENCE TO RELATED APPLICATIONS

The present application claims the benefit of the filing date of U.S. Provisional Application No. 62/368,296 filed Jul. 29, 2016, the disclosure of which is hereby incorporated by reference herein in its entirety.

BACKGROUND OF THE DISCLOSURE

It is well known that in order to keep oneself healthy and active, it is necessary to incorporate exercise into one's daily routine. Many people join gyms to help them exercise on a regular basis. A typical gym will include a number of "machines" or large equipment systems which are dedicated to exercise one or another part of the body. The user will have to move from machine to machine in order to exercise their entire body. Most of these machines utilize weights which the user will selectively engage with the machine in order to achieve the intensity of workout that they desire. If the user is inexperienced, there is the tendency to avoid particular machines simply because it is difficult to figure out what one is supposed to do on that machine. An inexperienced user or someone who is too ambitious may inadvertently injure themselves if too much weight is applied to any particular exercise. Additionally, in busier gyms, the wait time for particular machines may be long enough that it tends to discourage people from undertaking a full exercise routine. As a result, there exists a tendency to pick one or two favorite machines and exercises and simply overlook the rest of the body.

Because of the issue with weight-based equipment and the tendency of inexperienced users to accidentally injure themselves thereon, there has been a rise in the interest of using resistance bands during exercise. Resistance bands are elongated elastic or resilient members which may be stretched to greater or lesser degrees. They can be incorporated into an exercise routine for anyone from beginners through to experienced athletes.

The resistance bands themselves may come in a variety of different lengths, diameters, wall thicknesses and different resistances and may include handles or loops at either end. The user will select the appropriate length and resistance for the exercises they wish to perform. A user may initially begin exercising with a low resistance band and progressively change to resistance bands of higher resistance as they gain strength.

During an exercise routine, the user will grasp the handles in either hand and stretch the resistance band, or they may hold part of the resistance band using one or both feet, or they may pass the resistance band around a substantially immovable object, such as a pole or a support for a piece of heavy gym equipment. They may, alternatively, anchor one end of the resistance band by tying it off to a pole or fitness equipment support.

BRIEF SUMMARY OF THE DISCLOSURE

In one aspect of the present disclosure is an exercise device comprising two tubular members coupled to each other by at least one limit member, wherein a tension member is routed through a bore within each of the tubular members, and wherein the exercise device further comprises an adjustment member positioned at an outer end of each tubular member, each adjustment member fixedly coupled to an end of the tension member. In some embodiments, each adjustment member comprises a cable having one or more protuberances located thereon. In some embodiments, the adjustment member further comprises a knob fixed to the cable. In some embodiments, end caps are affixed to the outer ends of each tubular member, each end cap including an opening comprising a first portion having a size larger than the one or more protuberances, and a second portion having a size smaller than the one or more protuberances. In some embodiments, the second portion is a slit continuous with the first portion. In some embodiments, the slit comprises an indentation for releasably engaging the one or more protuberances. In some embodiments, the first and second portions are continuous with each other and joined via a slit having a size larger than a diameter of the cable. In some embodiments, the exercise device further comprises a plurality of attachment points. In some embodiments, the at least one limit member is coupled to a guide member on each of the tubular members. In some embodiments, each tubular member comprises one or more grips. In some embodiments, the tension member is a resistance band.

In another aspect of the present disclosure is a kit comprising (i) an exercise device comprising two tubular members coupled to each other by at least one limit member, wherein a tension member is routed through a bore within each of the tubular members, and wherein the exercise device further comprises an adjustment member positioned at an outer end of each tubular member, each adjustment member fixedly coupled to an end of the tension member; and (ii) at least once resistance band. In some embodiments, the kit further comprises at least two handle attachments. In some embodiments, the kit comprises at least two resistance bands. In some embodiments, the at least two resistance bands are the same. In some embodiments, the kit comprises three or more resistance bands.

In another aspect of the present disclosure is a device comprising a pair of tubular members coupled to each other by at least two limit members, wherein an elastic tension member is routed through a bore within each of the tubular members, and wherein the exercise device further comprises an adjustment member positioned at an outer end of each tubular member, each adjustment member including a wire having at least one protuberance, the wire of each adjustment member fixedly coupled to an end of the elastic tension member. In some embodiments, the adjustment member further comprises a knob fixed to the wire. In some embodiments, end caps are affixed to the outer ends of each tubular member, each end cap including an opening comprising a first portion having a size larger than the at least one protuberance, and a second portion having a size smaller than the one or more protuberances, wherein the first and second portions are continuous with each other. In some embodiments, the second portion is a slit having a size greater than a circumference of the wire but smaller than a size of the protuberance. In some embodiments, the protuberance is at least 5% larger in a dimension as compared with the circumference or width of the wire. In some embodiments, the second portion is configured to releasably engage the at least one protuberance.

In another aspect of the present disclosure is a device comprising a pair of tubular members coupled to each other by at least two limit members, wherein an elastic tension member is routed through a bore within each of the tubular members, and wherein the exercise device further comprises an adjustment member positioned at an outer end of each tubular member, each adjustment member including a wire having at least one engagement member positioned thereon, the wire of each adjustment member fixedly coupled to an end of the elastic tension member.

In another aspect of the present disclosure is a method of using the exercise device described in the above embodiments. In some embodiments, the method comprises pretensioning the tension member of the exercise device by releaseably engaging a protuberance with a component in an end cap.

Without wishing to be bound by any particular theory, Applicant believes that the disclosed exercise device is s superior to standard resistance band handles because it provides another direction of resistance and supplies continuous resistance through the entire range of motion.

DETAILED DESCRIPTION

Figure 1:
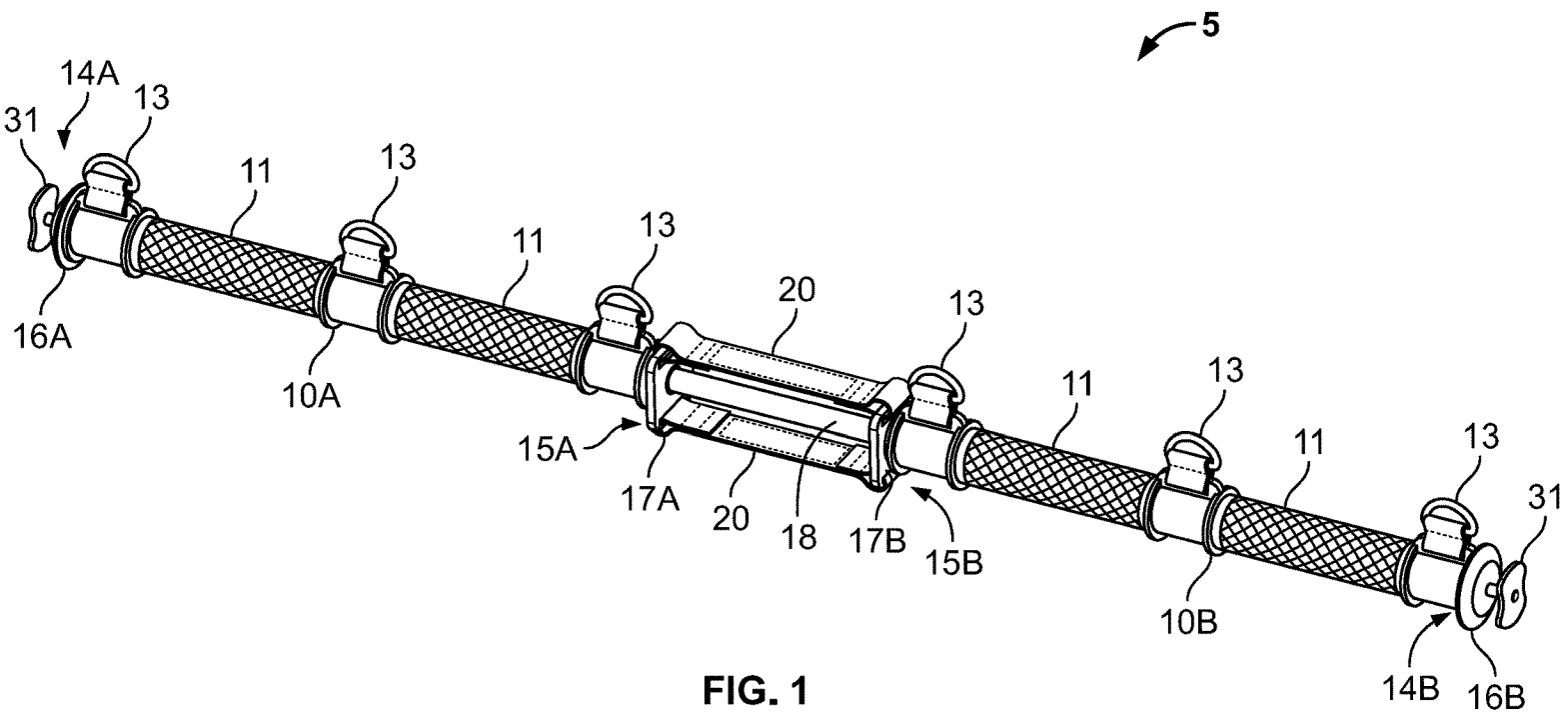
FIG. 1 sets forth a prospective view of an exercise device in a final state having two tubular members separated by a distance defined by a series of limit members.

It should also be understood that, unless clearly indicated to the contrary, in any methods claimed herein that include more than one step or act, the order of the steps or acts of the method is not necessarily limited to the order in which the steps or acts of the method are recited.

As used herein, the singular terms "a," "an," and "the" include plural referents unless context clearly indicates otherwise. Similarly, the word "or" is intended to include "and" unless the context clearly indicates otherwise. The term "includes" is defined inclusively, such that "includes A or B" means including A, B, or A and B.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of" or "exactly one of." "Consisting essentially of," when used in the claims, shall have its ordinary meaning as used in the field of patent law.

The terms "comprising," "including," "having," and the like are used interchangeably and have the same meaning. Similarly, "comprises," "includes," "has," and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c. Moreover, while the steps and processes may be outlined herein in a particular order, the skilled artisan will recognize that the ordering steps and processes may vary.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In general, the present disclosure provides an exercise device which focuses on strength training, and namely providing another direction of resistance as compared with training with resistance bands alone. Without wishing to be bound by any particular theory, it is believed that the disclosed exercise device is simple to use and relatively compact, and may be considered as a substitute for a gym barbell, a gym dumbbell, and/or gym cable system. It is also believed that the versatility and adjustability of the exercise device enables an array of exercise options while at home or traveling, or at any time the user is away from a gym. The exercise device enables a user to target muscle groups not only within the upper body, but also the lower body. The skilled artisan will appreciate the presently disclosed exercise device may be utilized in conjunction with one or more resistance bands and/or cables; or may be used alone as a stand-alone exercise device (i.e. without the use of any resistance bands, cables, etc.).

Figure 2:
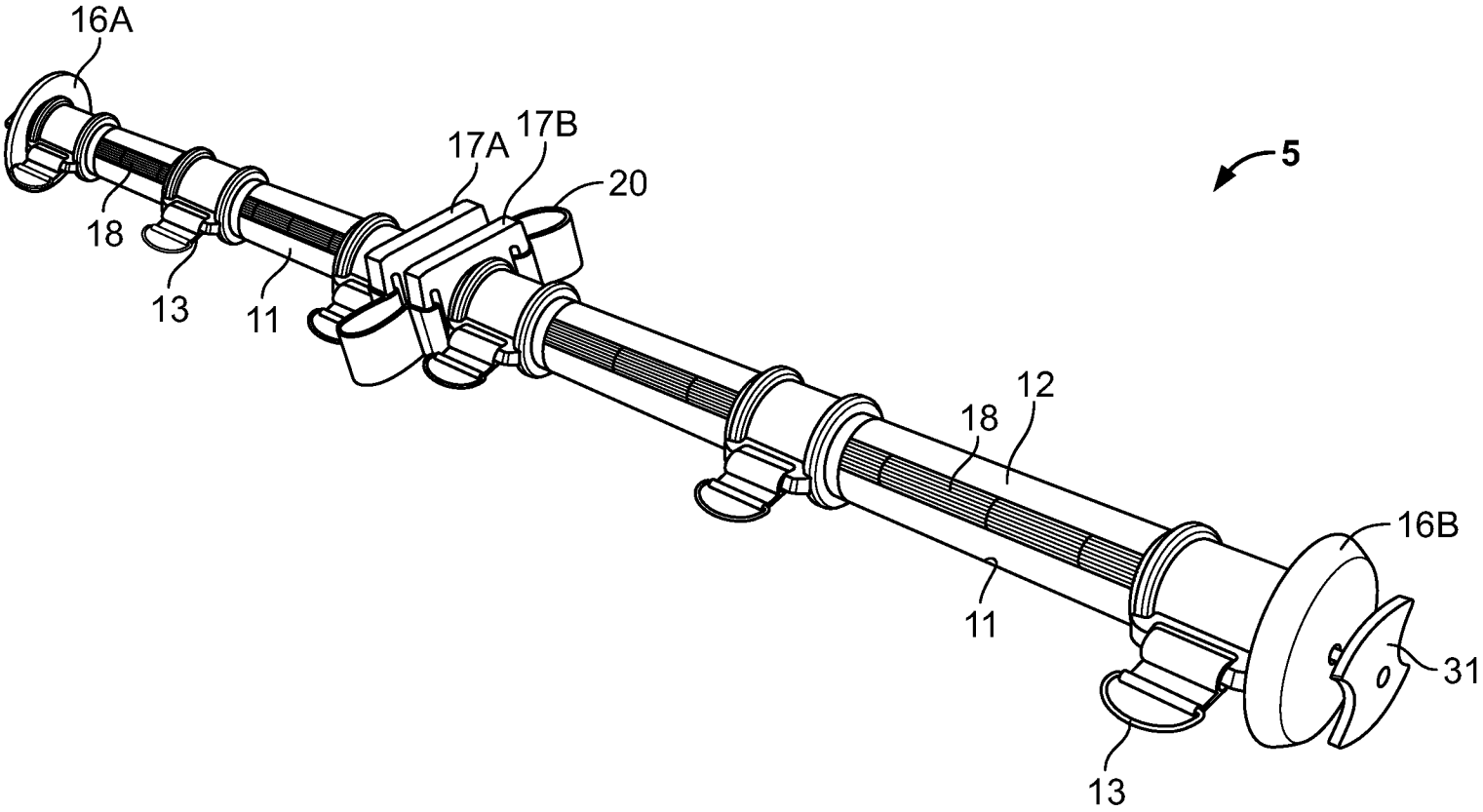
FIG. 2 sets forth a prospective cut-away view of an exercise in an initial state.

With reference to FIGS. 1 and 2, an exercise device 5 is depicted as having two tubular members 10A and 10B, with each tubular member 10A and 10B having substantially the same size and shape. In some embodiments, each tubular member is comprised of a metal (e.g. aluminum, steel, iron, copper) or a polymeric material. In some embodiments, the polymeric material is selected from polyethylenes, polypropylenes, polybutylenes, low vinyl polybutadienes, high vinyl polybutadienes, ABS polymers, epoxies, polyurethanes, EPDM polymers, cyclic olefin copolymers (COC), vinyl esters, polylactones, polycarbonates, polysulfones, polythioethers, polyetheretherketones (PEEK), polydimethylsiloxanes (PDMS), polyethylene terephthalates (PET), polybutylene terephthalates (PBT), and other commercially-available polymers or blends or copolymers thereof. The tubular members 10A and 10B may be manufactured by molding, casting, 3D-printing, or extruding, or any other method known to those of ordinary skill in the art.

In some embodiments, each tubular member has a first end 14A and 14B and a second end 15A and 15B. The first end 14A or 14B of each tubular member comprises an end cap 16A or 16B, respectively. In some embodiments, each end cap 16A or 16B is fixedly attached to the first end 14A or 14B, respectively. In some embodiments, each end cap 16A or 16B is bonded or glued to the first end 14A or 14B, respectively. In some embodiments, the second end 15A or 15B of each tubular member comprises a guide member 17A or 17B, where each guide member 17A or 17B is again fixedly attached to the second end 15A or 15B, respectively. In some embodiments, each guide member 17A or 17B is bonded or glued to the second end 15A or 15B, respectively. In other embodiments, the end caps and/or guide members may be fixed to the tubular members with fasteners, e.g. one or more screws, or with an adhesive.

Each tubular member 10A or 10B may comprise one or more attachment members 13 such that other exercise equipment may be independently releasably engaged with each tubular member. For example, each tubular member 10A or 10B may comprise one or more attachment members 13 such that resistance bands or cables may be directly attached thereto. In some embodiments, each tubular member 10A or 10B comprises at least two attachment members 13. In other embodiments, each tubular member 10A or 10B comprises at least three attachment members 13. In some embodiments, each attachment member 13 is spaced equally from another attachment member on any single tubular member 10A or 10B. For example, and as depicted in FIG. 1, a first attachment member may be positioned proximal to a first end 14A of the tubular member 10A, while a second attachment member may be posited proximal to a second end 15A of the tubular member 10A; and where a third attachment member is positioned equidistant from both the first and second attachment members, i.e. positioned at a midpoint between the first and second attachment members. The attachment members 13 themselves may have any size or shape. For example, the attachment members 13 may independently be selected from D-rings, hooks, etc. The attachment members 13 may be comprised of any resilient material, including plastics, metals, or alloys. In some embodiments, the attachment members are configured such that they may rotate around the circumference of the tubular member to which they are secured. In some embodiments, the attachment members are configured for up to 360 degrees of rotation around the tubular member. In other embodiments, the attachment members are configured for rotation for up to about 270 degrees of rotation. In other embodiments, the attachment members are configured for rotation for up to about 180 degrees of rotation. In other embodiments, the attachment members are configured for rotation for up to about 90 degrees of rotation. In other embodiments, the attachment members are configured for rotation for up to about 45 degrees of rotation. In other embodiments, the attachment members are configured for rotation for up to about 30 degrees of rotation. In other embodiments, the attachment members are configured for rotation for up to about 15 degrees of rotation.

Figure 7:
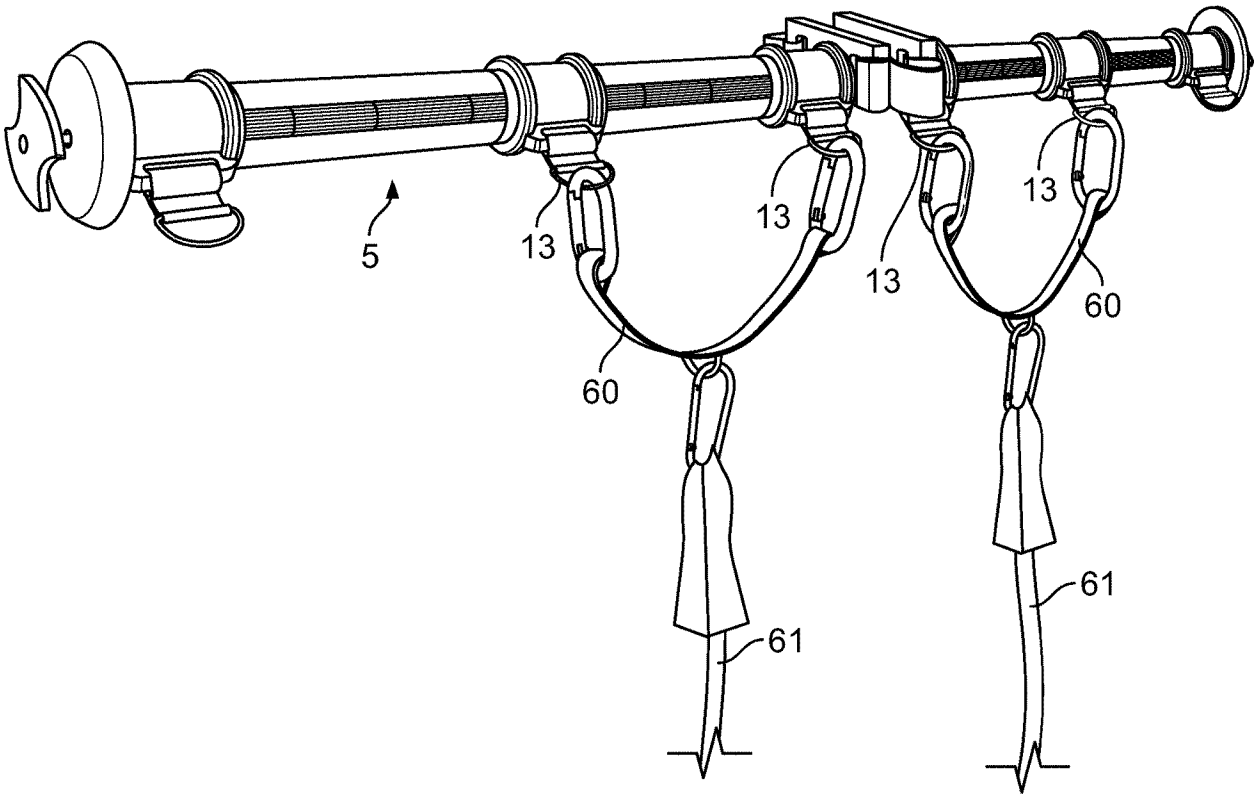
FIG. 7 sets forth a prospective view of an exercise device indirectly coupled to resistance bands.
Figure 9:
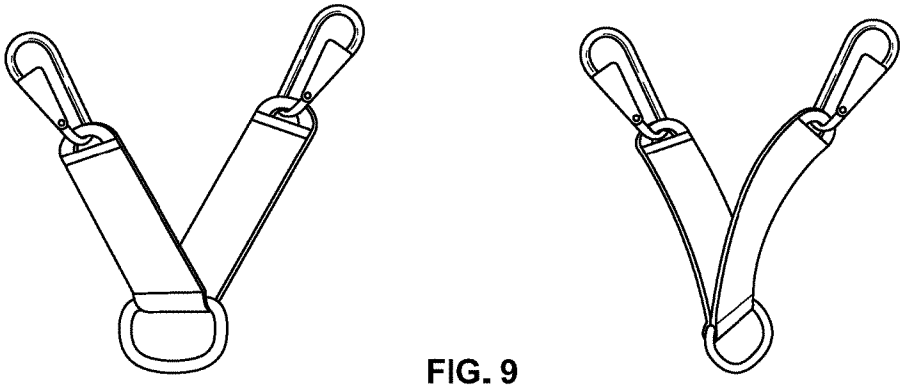
FIG. 9 illustrates handle attachments according to one embodiment of the present disclosure.

In some embodiments, one or more resistance bands or cables may be directly attached to the exercise device 5 through the one or more attachment members 13. In other embodiments, an intermediate attachment member may be positioned between one or more of attachment members 13 and a resistance band or cable, thus allowing the resistance bands to be indirectly attached to the exercise device. For example, a handle attachment 60 (see FIG. 9) may be coupled to the attachment members 13 as depicted in FIG. 7, such that resistance bands 61 may be indirectly attached to the exercise device 5. In some embodiments, the handle attachment 60 is comprised of two carabiners, and a d-ring; whereby the carabiners clip onto the d-ring of the bar.

Each tubular member 10A or 10B may further comprise one or more grips 11. In some embodiments, grips 11 may be integral with each tubular member 10A or 10B, i.e. the tubular member may be molded or cast to provide a gripping surface. In other embodiments, the grips 11 may be separate components added to the tubular members after manufacturing, e.g. a rubber gripping surface added over a molded or cast tubular member. The grips 11 may have any pattern so as to better facilitate a user's ability to maintain consistent control of the exercise device 5.

Each tubular member 10A and 10B may be connected to each other at their respective second ends 15A and 15B. In some embodiments, the tubular members 10A and 10B are connected to each other with at least two limit members 20. In some embodiments, the at least two limit members 20 are attached to hooks, eyelets, flanges, etc. present on the guide members 17A and 17B. In some embodiments, the limit members 20 not only serve to connect the tubular members 10A and 10B, but also to limit how far the tubular members 10A and 10B may be separated from one another. The purpose of the limit members 20 will become more apparent herein. In some embodiments, the at least two limit members 20 are each positioned opposite each other on the guide members 17. In other embodiments, the exercise device 5 comprises at least three limit members 20. In yet further embodiments, the exercise device 5 comprises at least four limit members 20. The skilled artisan will appreciate that when the exercise device 5 comprises more than two limit members 20, that the limit members may positioned on the guide members 17A and 17B and spaced equally from each other (e.g. 120 degrees from each other in the case of three limit members; 90 degrees from each other in the case of four limit members). In some embodiments, the limit members 20 are comprised of a material that is flexible, but does not stretch by any appreciable amount. In some embodiments, the limit members are comprised of a nylon material.

Again, with reference to FIG. 1, each tubular member 10A and 10B comprises a bore 12 running through the center of the tubular member. The bore 12 may have any cross-sectional size or shape, e.g. polygonal, square, circular, or ovoid, provided that a tension member 18 is able to fit therein without being impinged upon, i.e. any tension member 18 fitted within the bore 12 of the tubular members 10A and 10B must be able to expand (i.e. stretch) and contract without its movement being pinched or otherwise impaired. In some embodiments, the bore has a diameter ranging from 0.25 cm to about 2 cm. In other embodiments, the bore has a diameter ranging from 0.3 cm to about 2 cm. In yet other embodiments, the bore has a diameter ranging from about 0.5 cm to about 1.5 cm.

In some embodiments, a single tension member 18 runs through the bore 12 of the first tubular member 10A through the bore 12 of the second tubular member 10B. In some embodiments, the tension member 18 is an elastic band or resistance tube. As such, the tension member 18 is capable of expanding (or stretching) and contracting along its length, and thus has a first length at a fully contracted state, a range of intermediate lengths as the tubular member is stretched, and a final length when it cannot be further stretched (either because the tension member 18 is already stretched to its limits (i.e. the material of the tension member cannot sustain further stretching) or the maximum distance between the tubular members 10A and 10B is reached by means of the limit members 20). In some embodiments, the tension member has a tension ranging from between about 2 pounds to about 100 pounds. In some embodiments, the tension member has a tension ranging from between about 2 pounds to about 50 pounds. In some embodiments, the tension member has a tension ranging from between about 2 pounds to about 40 pounds. In some embodiments, the tension member has a tension ranging from between about 4 pounds to about 30 pounds. In some embodiments, the tension member has a tension ranging from between about 4 pounds to about 15 pounds.

In some embodiments, the tension member 18 has a length which is less than the combined length of each tubular member 10A and 10B in addition to the length of limit member 20. In some embodiments, the tension member 18 has a length which is between 5% and 50% less than the combined length of each tubular member 10A and 10B in addition to the length of limit member 20. In some embodiments, the tension member 18 has a length which is between 5% and 40% less than the combined length of each tubular member 10A and 10B in addition to the length of limit member 20. In some embodiments, the tension member 18 has a length which is between 5% and 30% less than the combined length of each tubular member 10A and 10B in addition to the length of limit member 20. In some embodiments, the tension member 18 has a length which is between 10% and 40% less than the combined length of each tubular member 10A and 10B in addition to the length of limit member 20. In some embodiments, the tension member 18 has a length which is between 10% and 30% less than the combined length of each tubular member 10A and 10B in addition to the length of limit member 20.

Figure 3:
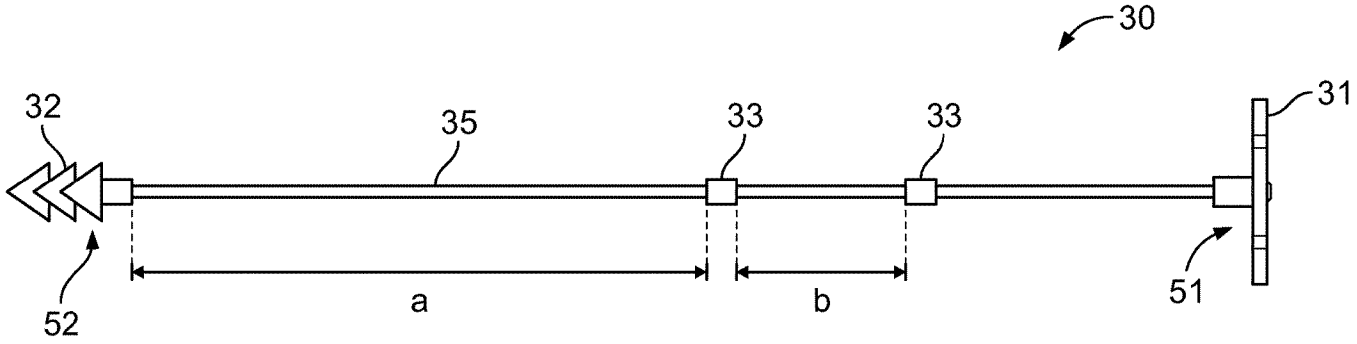
FIG. 3 provides a side view of an adjustment member.

The exercise device 5 comprises two adjustment members. With reference to FIG. 3, each adjustment member 30 comprises a cable 35, a pull knob 31 fixedly secured to a first end 51 of the cable, a coupler 32 fixedly secured to a second end 52 of the cable, and at least one engagement member 33 positioned along a portion of the cable. In some embodiments, each adjustment member 30 is located at a first end 14 or 14B of the tubular members 10A and 10B.

In some embodiments, cable 35 is flexible, but does not stretch to any discernable degree. That is, the cable 35 is comprised of a material or combination of materials that allows it to flex or bend, but not stretch to any discernable degree. As noted here, the skilled artisan will appreciate that while cable 35 may move relative to the tubular members 10A or 10B, i.e. in and out of the first end of each tubular member, the cable 35 does not itself stretch, at least not to any discernable degree. In some embodiments, the cable may be a metal wire, a braided metal or fibrous wire (i.e. the cable may include multiple cords of individual metal or fibrous wires braided together), or a molded or extruded plastic wire or filament.

In some embodiments, the at least one engagement member 33 is a metal, plastic, or composite protuberance that extends from and encircles a portion of the cable 35. The at least one engagement member 33 may have any size or shape provided that it is able to pass through opening 40 and engage with retention member 34 or groove 41 as noted herein (see FIGS. 3, 4A, and 4B). In some embodiments, each adjustment member 30 comprises a single engagement member 33. In other embodiments, each adjustment member 30 comprises at least two engagement members 33. In some embodiments, the engagement member is spherical. In some embodiments, the engagement member is a cube. In some embodiments, the engagement member is a disk, such as a disk having any thickness. In other embodiments, the engagement member has no defined shape.

Figure 5:
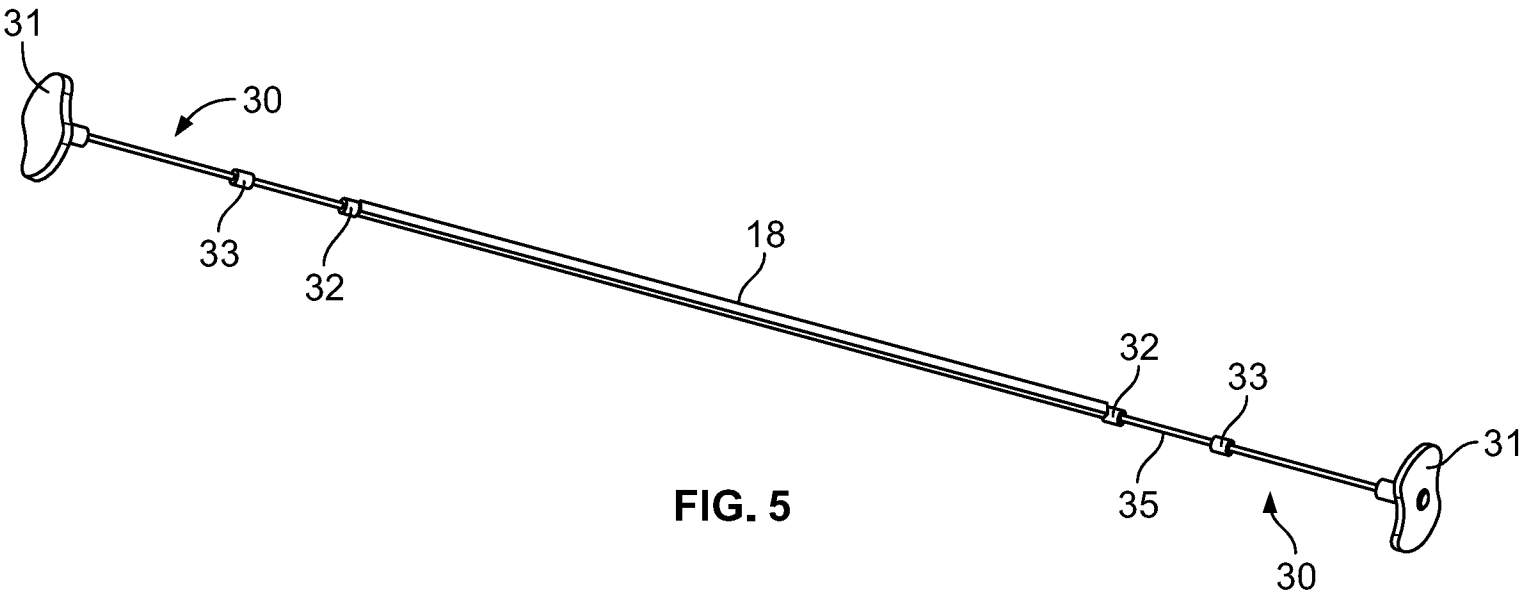
FIG. 5 provides a prospective view of two attachment members coupled to a tension member.

In some embodiments, the coupler 32 is a series of barbs that are fixed to the cable 35. In some embodiments, the coupler 32 is configured such that it engages an open end of the tension member 18, such that when the cable 35 is pulled, the tension member 18 is likewise pulled (and thus moved from a contracted state (or un-stretched state) to an at least partially expanded state (or stretched state)). Said another way, when the knob 31 is pulled, the cable 35 will concomitantly be pulled; and by virtue of the cable's 35 engagement (via the coupler 32) with the tension member 18, the tension member 18 is likewise pulled. FIG. 5 illustrates two adjustment members 30 coupled to a tension member 18. In some embodiments, the coupler 32 may be crimped, via metal crimps, to the cable 35 and over-molded with plastic to ensure that the individual components do not separate when a force is applied to the exercise device 5. In some embodiments, a crimp, a wire tie, and/or heat shrink tubing may be used to further secure the tension member 18 to the coupler 32.

Figure 4B:
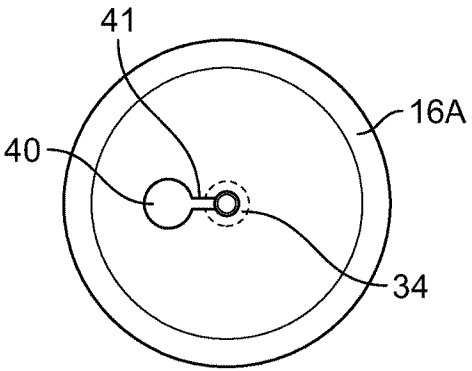
FIGS. 4A and 4B illustrate alternative and non-limiting embodiments of an end-cap for engagement with an end of a tubular member.
Figure 4A:
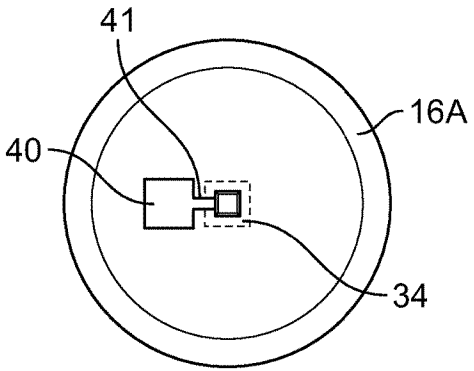

With reference to FIGS. 4A and 4B the end caps 16A and 16B comprise an opening 40 allowing for the cable 35 and any engagement members 33 disposed thereon to pass freely through. As such, the opening 40 is of a size and/or shape which is large enough to accommodate the passage of an engagement member 33 without obstructing the engagement member 33 from being passed through. In some embodiments, the end caps 16A and 16B further comprise a retention member 34 and groove 41, both in communication with the opening 40. In some embodiments, the retention member 34 and/or groove 41 are of a size sufficient for the cable 35 to slide into, but small enough such that the engagement member 33 is unable to fit. In some embodiments, the retention member 34 comprises an indention within the endcap 16A or 16B having a shape which roughly approximates that of the engagement member 33, such that the engagement member 33 is releasably engaged with the end cap. In some embodiments, the retention member 34 and groove 41 are the same.

Figure 6A:
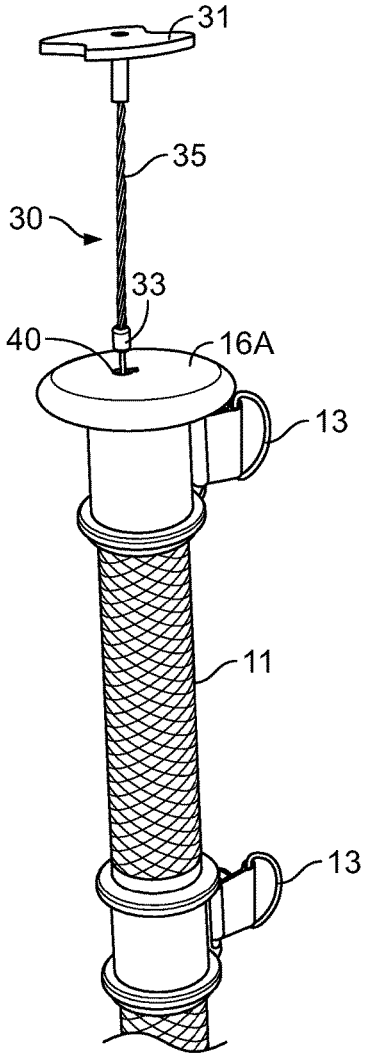
FIG. 6A illustrates an attachment member pulled from the bore of a tubular member, whereby an engagement member is not in contact with the end cap.
Figure 6B:
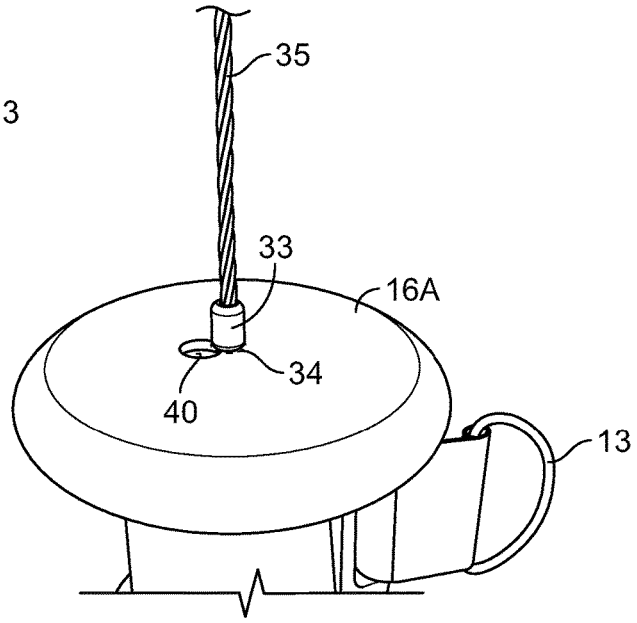
FIG. 6B illustrates an attachment member pulled from the bore of a tubular member, whereby an engagement member is in communication with a retention member.

With reference to FIGS. 6A and 6B, when the cable 35 is pulled through opening 40 and an engagement member 33 is positioned in communication with a retention member 34 or slotted groove 41, that the cable will remain in the "pulled" position and at a length determined by the length of cable between the engagement member 33 and the knob 31. Thus, when an engagement member 33 is positioned in communication with retention member 34 or groove 41, the tension member 18 remains in the stretched conformation, i.e. a pre-tensioned conformation.

Figure 8A:
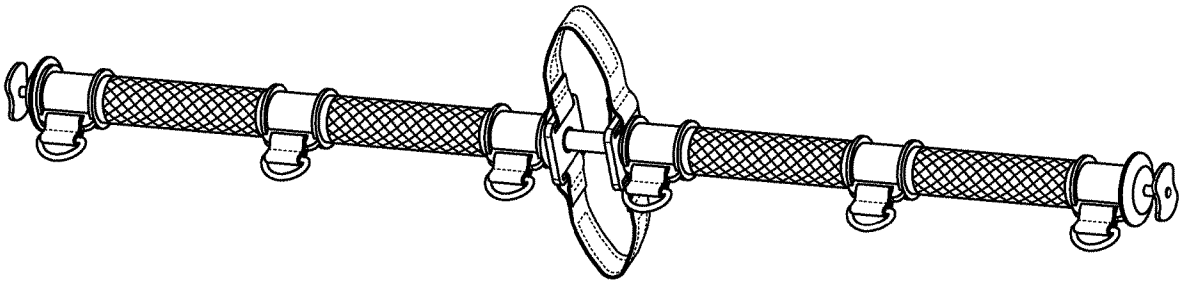
FIGS. 8A and 8B comparatively illustrate an exercise device in an initial state and a final state.
Figure 8B:
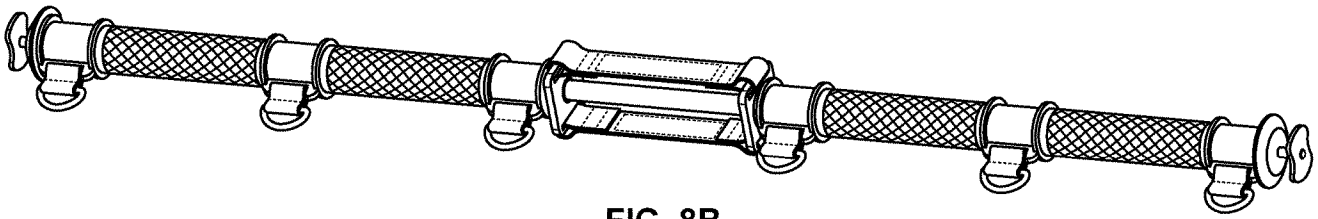

During use, the exercise device 5 may transition from an initial state (see FIG. 2), to a final state (see FIG. 1), and through any number of intermediate states between the initial state and final state (see also FIGS. 8A and 8B, which comparatively illustrate an initial state and final state of the exercise device). FIG. 2 depicts the exercise device 5 in an initial state. In this initial state, the two guide members 17A and 17B are positioned proximal to each other, the limit members 20 are slack, and the tension member 18 may be in (i) an un-stretched state, or (ii) a pre-tensioned state. By "un-stretched state" is meant that the tension member 18 is fully contracted, i.e. there is no force pulling on either end of the tension member 18. By "pre-tensioned state" is meant that there is a force pulling on one or both ends of the tension member 18, such that the tension member 18 is taunt and at least partially stretched.

A pre-tensioned state may be generated by (i) engaging one or more of the engagement members within a retention member, thus pulling one or both sides of the tension member by a pre-determined amount (see, for example, "a" and "b" of FIG. 3); and/or (ii) selecting component sizes such that when the knobs 31 are in contact with the end caps 16A and/or 16B, the cable 35 tugs on a tension member 18 which is shorter than the total length of (a) the cable 35, (b) the tubular members 10A and 10B, and (c) slack limit members 20, thereby at least partially stretching the tension member 18. In some embodiments, when the exercise device is not pre-tensioned (i.e. the engagement members 33 are not in communication with retention members 34), the knobs 31 may be resting on the end caps 16A and 16B such that the entirety of the cable 35 and any engagement members are positioned within the bore 12 of the tubular members 10A and 10B.

In operation, the user will pull the two tubular members away 10A and 10B away from each other through a number of intermediate states and to a final state. Any number of intermediate states between the initial and final states are possible, and at each intermediate state the limit members 20 are at least partially slack and the tension member 18 is also at least partially stretched. FIG. 1 depicts a final state whereby the tubular members 10A and 10B are separated from one another and at a distance dictated by the maximum length of the limit members 20. In the final state, the limit members 30 are fully taut and the tension member 18 is in a stretched state.

The skilled artisan will appreciate that as the user pulls apart the tubular members 10A and 10B an energy must be exerted by the user to stretch the tubular member 18, or maintain the tubular member 18 in an at least partially stretched state. As such, use of the presently disclosed exercise device alone, i.e. without the use of resistance bands or cables, allows for the user to exert energy and work a set of muscles including core muscles and stabilizer muscles. Likewise, as the user operates the presently disclosed exercise device in conjunction with resistance bands and/or cables coupled to the attachment members, the user must maintain the exercise device in its final state or an intermediate state, thereby continuously exerting energy, and thereby working a set of muscles, including stabilizer muscles and/or core muscles, in addition to those muscles worked while using the resistance bands or cables in their traditional manner. In some embodiments, the tubular member 18 may be pre-tensioned prior to exercise by engaging one or more of the engagement members 33 within a retention member 34 or groove 41. The tension member 18 may be pre-tensioned from one or both of the adjustment members 30. In this way, the pre-tensioning of the tension member 18 causes the user to exert comparatively more energy (i.e. to perform additional work) to maintain the first and second tubular members in any of the intermediate or final states.

All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

Although the present disclosure has been described with reference to a number of illustrative embodiments, it should be understood that numerous other modifications and embodiments can be devised by those skilled in the art that will fall within the spirit and scope of the principles of this disclosure. More particularly, reasonable variations and modifications are possible in the component parts and/or arrangements of the subject combination arrangement within the scope of the foregoing disclosure, the drawings, and the appended claims without departing from the spirit of the disclosure. In addition to variations and modifications in the component parts and/or arrangements, alternative uses will also be apparent to those skilled in the art.

The invention claimed is:

1. An exercise device comprising a first tubular member and a second tubular member coupled to each other by at least one limit member, wherein a tension member is routed through a bore within each of the first and second tubular members, and wherein the exercise device further comprises a first adjustment member and a second adjustment member, wherein the first adjustment member is positioned at a first outer end of the first tubular member, and the second adjustment member is positioned at a second outer end of the second tubular member, and wherein the first adjustment member is fixedly coupled to a first end of the tension member, and the second adjustment member is fixedly coupled to a second end of the tension member.

2. The exercise device of claim 1, wherein the first and second adjustment members each comprises a cable having one or more protuberances located thereon.

3. The exercise device of claim 2, wherein the first and second adjustment members further comprises a knob fixed to the cable.

4. The exercise device of claim 2, wherein end caps are affixed to the first and second outer ends of each of the first and second tubular members respectively, each of the end caps including an opening comprising a first portion having a size larger than the one or more protuberances, and a second portion having a size smaller than the one or more protuberances.

5. The exercise device of claim 4, wherein the second portion is a slit continuous with the first portion.

6. The exercise device of claim 5, wherein the slit comprises an indentation for releasably engaging the one or more protuberances.

7. The exercise device of claim 4, wherein the first and second portions are continuous with each other and joined via a slit having a size larger than a diameter of the cable.

8. The exercise device of claim 1, further comprising a plurality of attachment points.

9. The exercise device of claim 1, wherein the at least one limit member is coupled to a guide member on each of the first and second tubular members.

10. The exercise device of claim 1, wherein each of the first and second tubular members comprises one or more grips.

11. The exercise device of claim 1, wherein the tension member is a resistance band.

12. A kit comprising the exercise device of claim 1 and at least two resistance bands.

13. The kit of claim 12, further comprising at least two handle attachments.

14. The kit of claim 12, wherein the at least two resistance bands are the same.

15. An exercise device consisting essentially of first and second tubular members coupled to each other by at least one limit member, wherein a tension member is routed through a bore within each of the first and second tubular members, wherein the exercise device further comprises a first adjustment member positioned at a first outer end of the first tubular member and a second adjustment member positioned at a second outer end of the second tubular member, and wherein the first adjustment member is fixedly coupled to first end of the tension member and the second adjustment member is fixedly coupled to a second end of the tension member, and wherein each of the first and second adjustment members comprises a cable having one or more protuberances located thereon.

16. An exercise device comprising a pair of tubular members coupled to each other by at least two limit members, wherein an elastic tension member is routed through a bore within each tubular member of the pair of tubular members, and wherein the exercise device further comprises an adjustment member positioned at an outer end of each of the pair of tubular members, each of the adjustment members including a wire having at least one protuberance, the wire of a first adjustment member is fixedly coupled to a first end of the elastic tension member and the wire of a second adjustment member is fixedly coupled to a second end of the elastic tension member.

17. The exercise device of claim 16, wherein each of the adjustment members further comprises a knob fixed to the wire.

18. The exercise device of claim 16, wherein end caps are affixed to the outer ends of each of the pair of tubular members, each of the end caps including an opening comprising a first portion having a size larger than the at least one protuberance, and a second portion having a size smaller than the at least one protuberances, wherein the first and second portions are continuous with each other.

19. The exercise device of claim 18, wherein the second portion is a slit having a size greater than a circumference of the wire but smaller than a size of the at least one protuberance.

20. The exercise of claim 18, wherein the second portion is configured to releasably engage the at least one protuberance.

* * * * *